US005220153A

United States Patent [19]

Malone et al.

[11] Patent Number: 5,220,153

[45] Date of Patent: Jun. 15, 1993

[54] MOTORIZED RANGE LOCK

[75] Inventors: Charles F. Malone, Franklin; James D. Edwards, Brentwood, both of Tenn.

[73] Assignee: France/Scott Fetzer Company, Fairview, Tenn.

[21] Appl. No.: 881,992

[22] Filed: May 1, 1992

[51] Int. Cl.[5] ..... H05B 1/02

[52] U.S. Cl. ..... 219/412; 126/197; 219/413; 292/DIG. 69

[58] Field of Search ..... 219/412, 413; 126/197; 292/111, 112, 113, 97, 197, 199, DIG. 69

[56] References Cited

U.S. PATENT DOCUMENTS

| | | | |
|---|---|---|---|
| 3,313,918 | 4/1967 | Barber . | |
| 3,409,320 | 11/1968 | Eckerle . | |
| 3,462,584 | 8/1969 | Guy . | |
| 3,476,424 | 11/1969 | Erickson . | |
| 3,610,883 | 7/1973 | Holtkamp . | |
| 3,745,988 | 7/1973 | Frick . | |
| 3,750,643 | 8/1973 | Fowler et al. . | |
| 3,859,979 | 1/1975 | Gilliom | 219/398 |
| 3,875,372 | 4/1975 | Gilliom | 219/413 |
| 3,889,654 | 6/1975 | Kauranen et al. | 126/197 |
| 3,968,983 | 7/1976 | Heit et al. | 292/201 |
| 4,082,078 | 4/1978 | Thuleen et al. | 126/197 |
| 4,109,637 | 8/1978 | Drouin | 126/197 |
| 4,163,443 | 8/1979 | Peterson | 126/197 |
| 4,316,079 | 2/1982 | Schmitz | 219/413 |
| 4,340,806 | 7/1982 | Bergquist | 219/413 |
| 4,351,288 | 9/1982 | Gasloli | 126/197 |
| 4,374,320 | 2/1983 | Barnett | 219/413 |
| 4,593,945 | 6/1986 | Arate et al. | 292/201 |
| 4,623,179 | 11/1986 | Davis et al. | 292/201 |
| 4,927,996 | 5/1990 | Genbauffe | 219/413 |
| 4,982,984 | 1/1991 | Yokota | 292/201 |
| 4,994,653 | 2/1991 | Kadwell et al. | 219/508 |
| 5,029,910 | 7/1991 | Genbauffe et al. | 292/110 |

*Primary Examiner*—Teresa J. Walberg
*Attorney, Agent, or Firm*—Wood, Herron & Evans

[57] ABSTRACT

An oven latch mechanism for heat-cleaning ovens is disclosed. The latch mechanism employs a unidirectional rotating d.c. motor to automatically latch the oven door upon initiation of a heat-cleaning operation and to automatically unlatch the door after a heat-clean operation and after the oven has reached a predetermined lower temperature. The latch mechanism includes a latch arm which moves arcuately through a variety of positions. The latch member senses whether the door is open and follows a different path of motion accordingly. If the latch member senses an open door, it returns to an unlatched position.

8 Claims, 15 Drawing Sheets

MOTORIZED RANGE LOCK

BACKGROUND OF THE INVENTION

1. Field of the Invention

The present invention relates to door locks for ranges and ovens, and more particularly, to motorized range and oven locks for the doors of self-cleaning ovens.

2. Description of Related Art

Modern ovens are often equipped with the capability to self-clean. Self-cleaning is accomplished by heating the oven to temperatures of approximately 400°–480° C. (750°–900° F.). Self-cleaning ovens typically employ a locking mechanism to lock the oven door during the cleaning operation. Existing door locks take various forms, the most advanced of which will automatically lock the door at the beginning of the cleaning operation and automatically unlock the door when the oven reaches a predetermined reduced temperature.

Some existing automatic door locks employ motors to actuate the lock. One example is described in U.S. Pat. No. 4,927,996. Conventionally, ovens use A.C. powered circuits. Therefore, existing motorized oven locks, such as disclosed in the referenced patent, employ A.C. motors. With the advent of microprocessor controllers, some advanced ovens have been provided with a low-voltage D.C. powered microprocessor controller and a low-voltage D.C. power supply for powering the controller. The D.C. microprocessor controller thus controls the lock motor and other functions according to a predetermined program. In microprocessor controlled ovens, D.C. controlled relays are added for switching A.C. powered devices such as the lock motor. The addition of a relay to control the lock motor adds to the cost of the oven and increases the number of parts and the possibility of a malfunction.

A problem facing oven designers is the protection of the motor and lock parts from the intense heat of the oven cavity. The usual location of an oven door latch is at the top center of the door, which, particularly during the self-cleaning operation, is a hot location. Existing self-cleaning ovens often have the oven lock motor mounted remotely from the door latch in a relatively cool location. In these designs, a linkage connects the door latch with the motor. Some designs incorporate a cooling fan to cool the motor and actuating mechanism. In addition, heat shields and insulation are used to isolate the door latch motor from the hot oven cavity. The measures used to protect the motor and actuating mechanism from heat add significant cost to the oven. There is a need for a heat-resistant unitary lock mechanism which can be mounted to the front center latch position of an oven.

SUMMARY OF THE INVENTION

It is an object of this invention to provide a motorized latch mechanism which is compatible with a D.C. powered microprocessor controller without the need for a motor relay.

Another object is to provide a latching mechanism for self-cleaning oven doors which can withstand high temperatures without the need for remote mounting of the motor or a cooling fan or other cooling measures.

A further object of the invention is to provide a latching mechanism which senses whether the oven door is open, and upon sensing an open door, returns to an unlatched position.

A further object of the invention is to provide a latch member with a minimal number of parts for greater reliability and simplified assembly.

The invention preferably embodies an improved door latching mechanism for use in a self-cleaning oven having a door movable between open and closed positions, and a device for effecting a heat cleaning cycle when the door has been closed and latched. The latch mechanism includes a mounting plate, a movable latch arm, a latch arm drive on the plate including a motor, a drive member rotatable through 360° in operative engagement with the latch arm, and a gear drive operatively interposed between the motor and the drive member. The arm and plate include structure for controlling the path of movement of the latch arm whereby actuation of the motor and unidirectional rotation of the driver when the door is closed will cause the latching end of the arm to move from an unlatched position to a latching position. Actuation of the motor and unidirectional rotation of the driver when the oven door is open will cause the latching end of the arm to move from the unlatched position to a reversing position and back to the unlatched position. The mechanism further includes a switching device for sensing the latched and unlatched positions of the arm and a rotatable program cam for permitting actuation of the switching device in the latched and unlatched positions. A member is carried by the arm for overriding the program cam and preventing actuation of the switching device when the arm moves to the reversing position.

The cam program and the override member provide a simple reliable switching mechanism for not only controlling the motor but for verifying that the latch member is in its latching position. This mechanism eliminates the need for a separate "latching position" verification switch for permitting the heat clean operation to begin. By combining these functions, the number of parts and assembly steps has been reduced, and reliability has been increased.

Other objects and advantages and a fuller understanding of the invention will be had from the following detailed description of the preferred embodiments and the accompanying drawings.

BRIEF DESCRIPTION OF THE DRAWINGS

Preferred embodiments of the invention are shown in the accompanying drawings in which.

DESCRIPTION OF THE PREFERRED EMBODIMENTS

Figure 1:
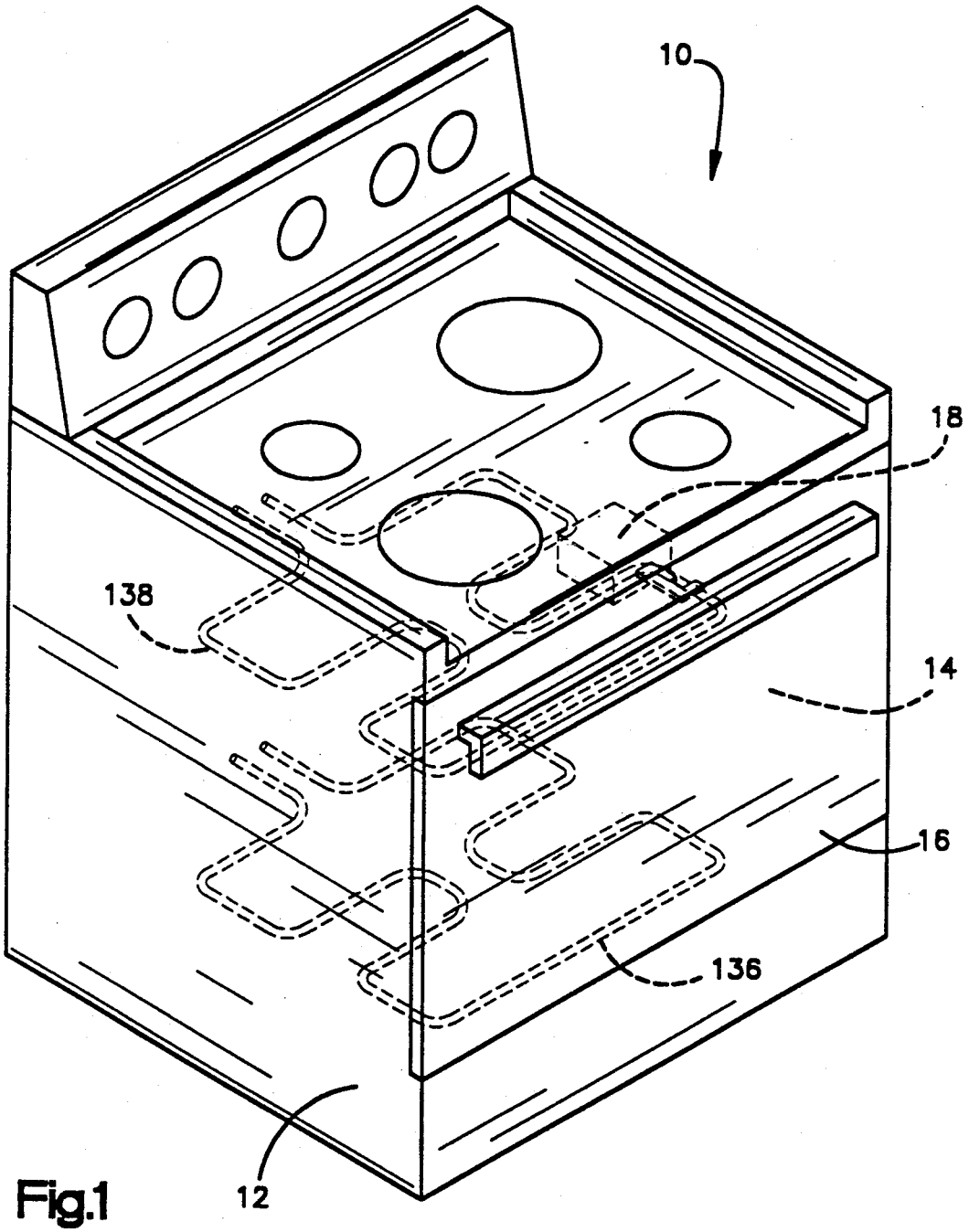
FIG. 1 is a perspective view of an oven having a latching mechanism embodying the present invention.

Referring to FIG. 1, a cooking apparatus is generally designated by the reference numeral 10. The cooking apparatus 10 includes a frame 12, a cooking chamber 14, a door 16, and a latch mechanism 18 embodying the present invention. During a self-cleaning operation, the latch mechanism 18, which includes a latch arm, automatically latches the door 16 to the frame 12. The latch mechanism 18 automatically releases the door 16 after the self-cleaning operation is completed and the temperature of the cooking chamber 14 has fallen to a predetermined temperature. The cleaning operation cannot be started without a verification signal that the door 16 is latched and closed. If the door 16 is open when an attempt is made to initiate the self-cleaning operation, the latch mechanism 18 will attempt to latch the door 16, but upon failing to sense that the door 16 is closed, will automatically return the latch arm to its original position.

The latch mechanism 18 is fixed to the frame 12 in a position near the front and center of the cooking apparatus 10 and just above the cooking chamber 14 as illustrated in FIG. 1. The latch mechanism includes a mounting plate 20, a latch arm 22, an eccentric driver pin 24, a program cam 26, a gear reduction transmission 28, a D.C. motor 30, and a switch block 32. The motor 30 drives the program cam 26 and the driver pin 24 via the transmission 28. The motor 30 is energized and deenergized by an electronic control unit 32 which receives signals from a switch block 34. Rotation of the motor 30 and the driver pin 24 in a single direction causes both latching and unlatching of the door 16.

Figure 2:
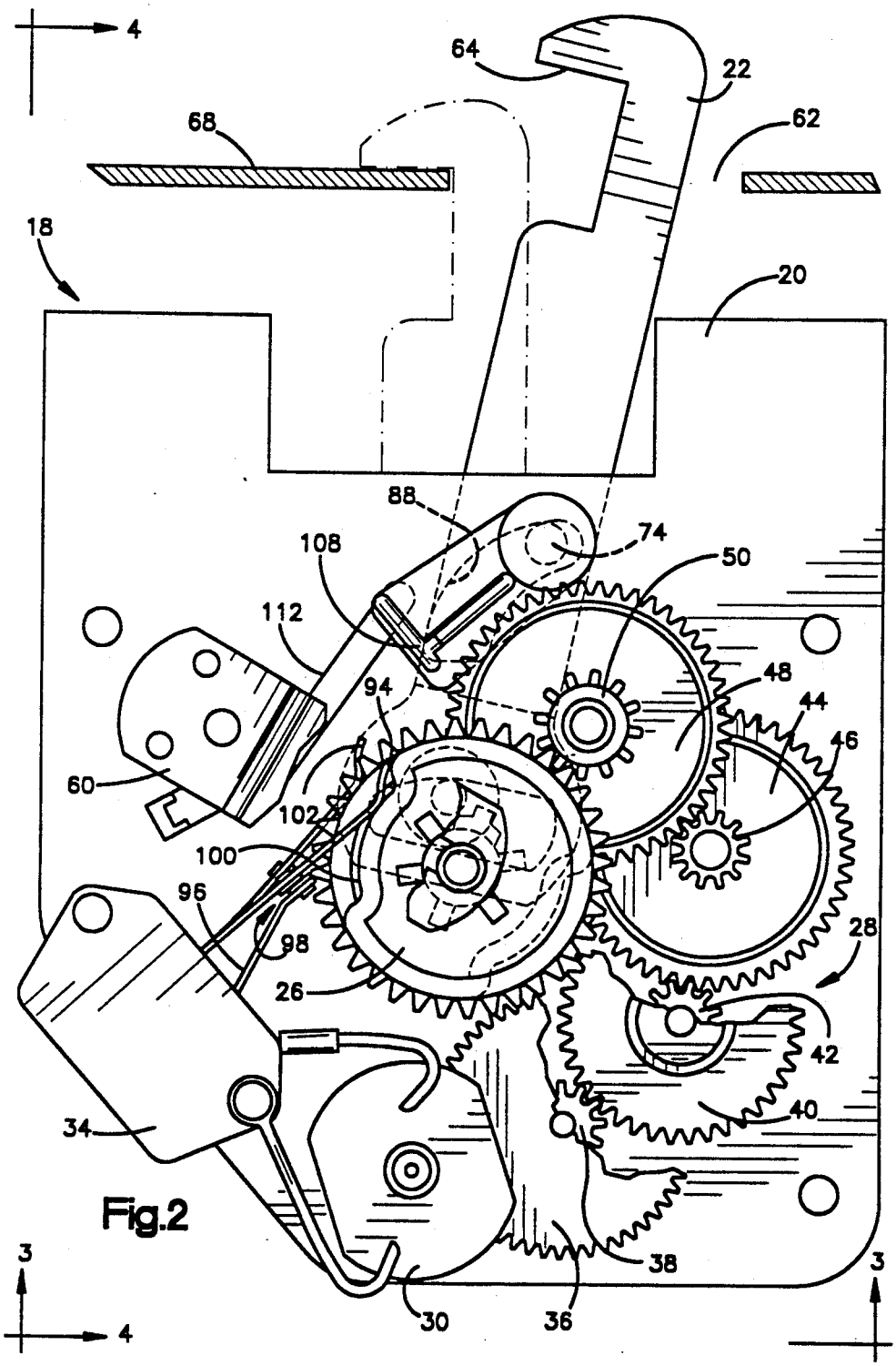
FIG. 2 is a top plan view of the latching mechanism.
Figure 3:
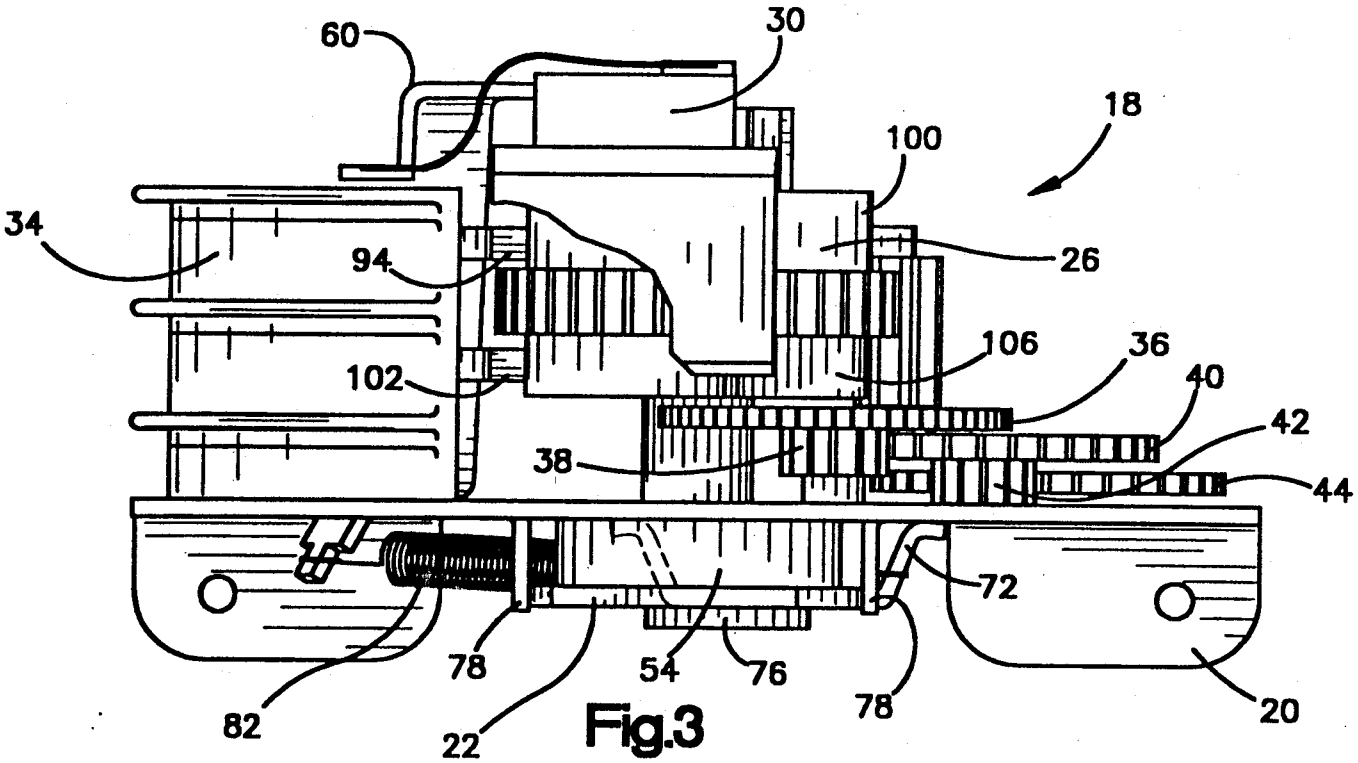
FIG. 3 is an elevational view as seen approximately from the plane indicated by the line 3—3 of FIG. 2.
Figure 4:
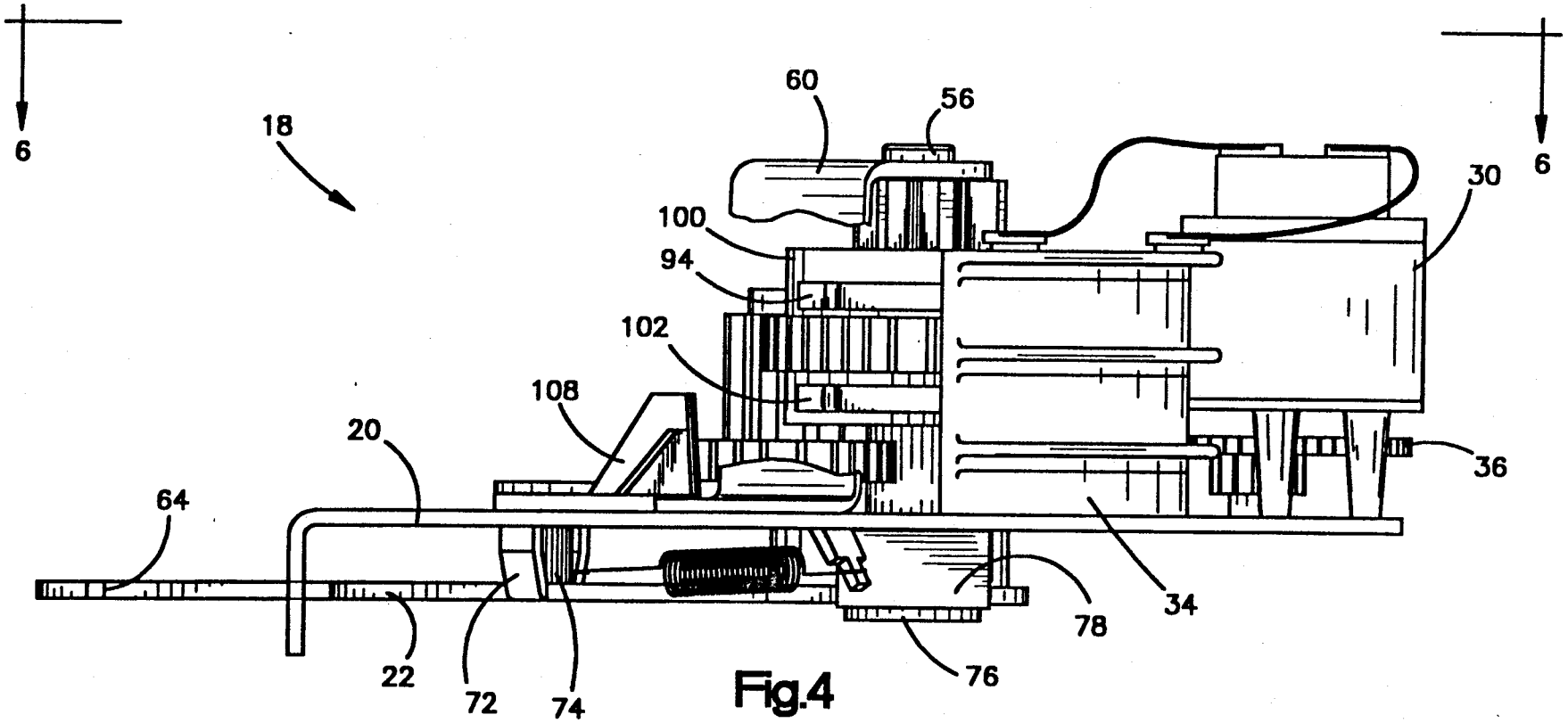
FIG. 4 is an elevational view as seen approximately from the plane indicated by the line 4—4 of FIG. 2.
Figure 5:
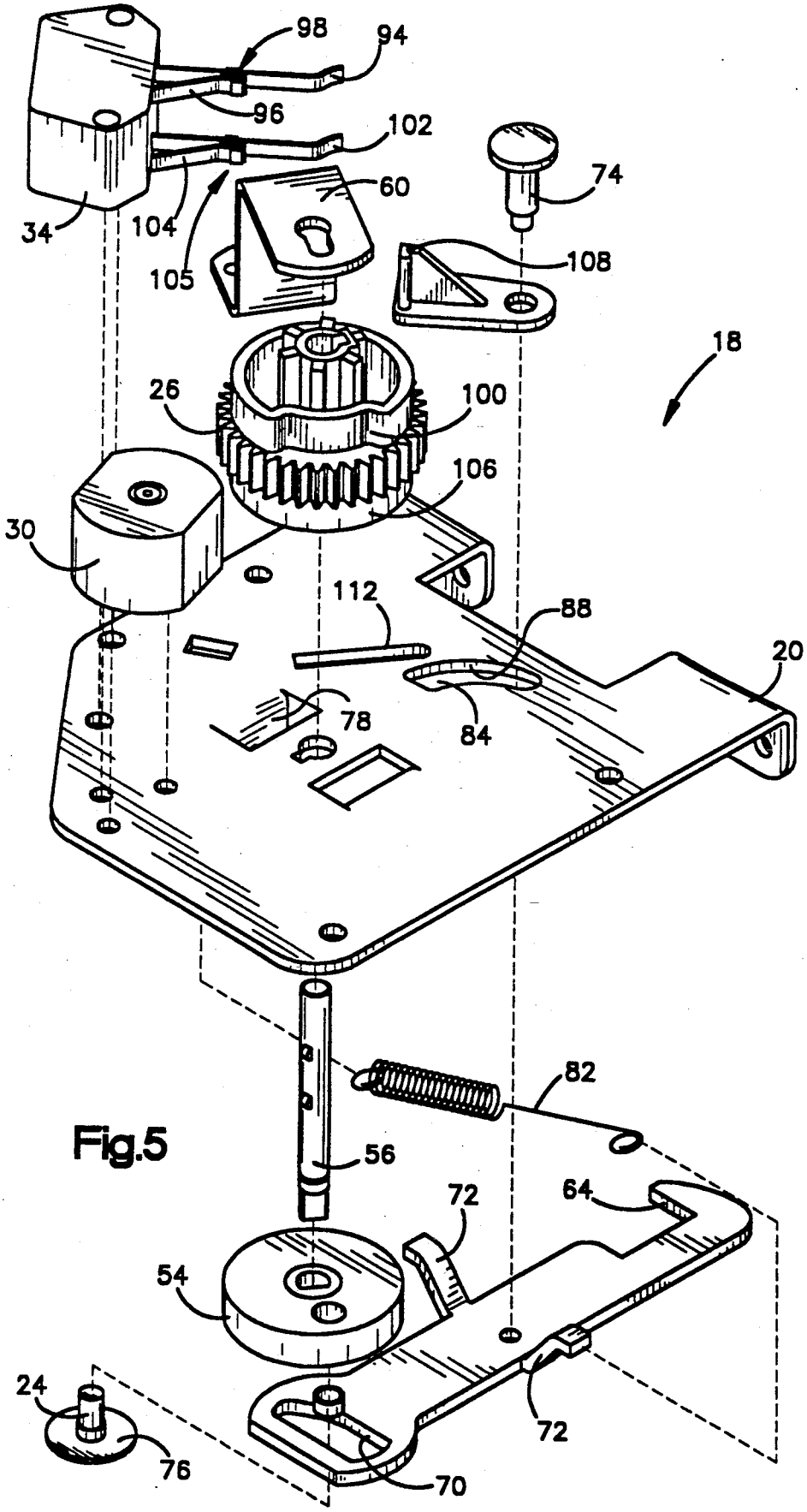
FIG. 5 is an exploded perspective view of portions of the latching mechanism of FIG. 5.

Referring to FIGS. 2 and 4, the D.C. motor 30 is fixed to the mounting plate 20 such that its output shaft is normal to the plane of the mounting plate 20. The motor has a pinion (not shown) for driving a first gear 36 (FIG. 2). The gear 36 has a pinion 38 fixed thereto for engaging a second gear 42. A pinion 42 fixed to the gear 40 drives a third gear 44. The third gear 44 is fixed to a pinion 46 which engages a fourth gear 48, the pinion 50 of which engages a set of teeth formed on the periphery of the program cam 26. The gears 36, 40, 44, 48 and their associated pinions 38, 42, 46, 50 greatly reduce the speed of the motor 30 such that the program cam 26 is driven at a relatively slow speed. The gears 36, 40, 44, 48 and their associated pinions 38, 42, 46, 50 are rotatably mounted on shafts which are fixed to the mounting plate 20. The program cam 26 is rotatably fixed to a driver wheel 54 by a drive shaft 56 (FIG. 5). The driver wheel 54 is connected to the driver pin 24 for causing the latch arm 22 to move to its various positions. The drive shaft 56 is rotatably mounted at one end to the mounting plate 20 and at the other end to a bracket 60 which is fixed to the mounting plate 20.

Figure 6A:
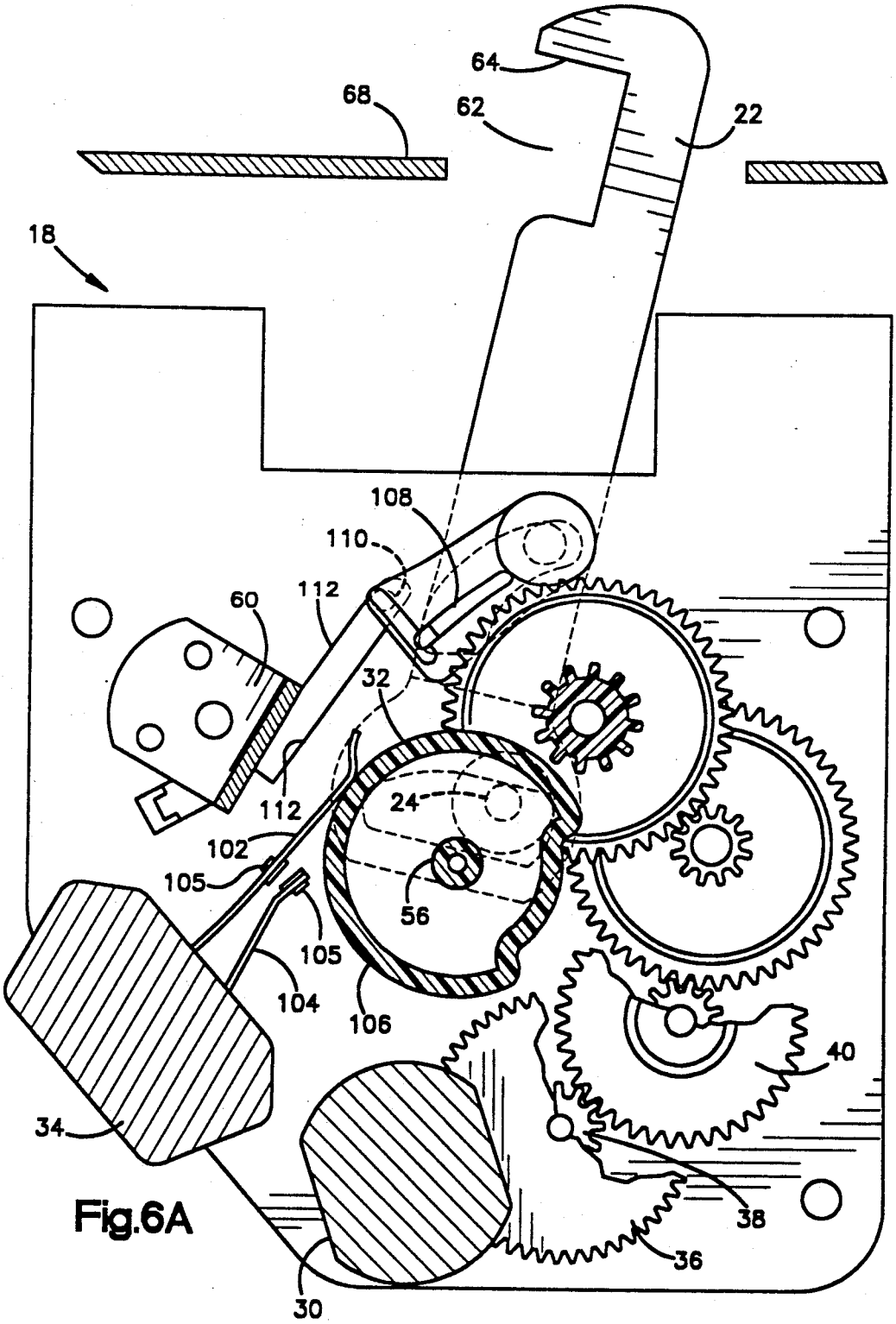
FIGS. 6A–6F are cross sectional views of the latch mechanism in various positions as seen approximately from the plane indicated by the line 6—6 of FIG. 4.
Figure 6B:
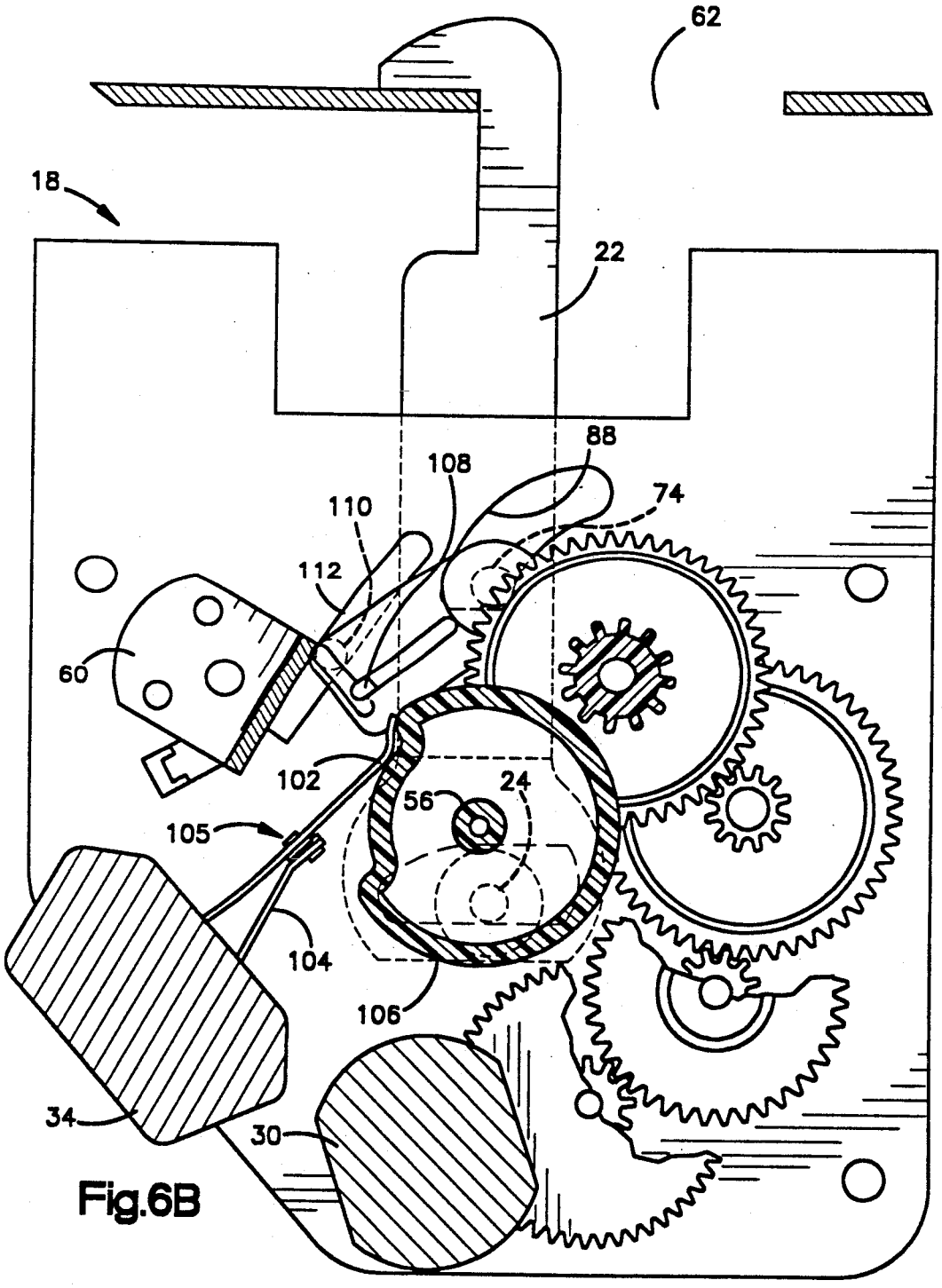
Figure 6C:
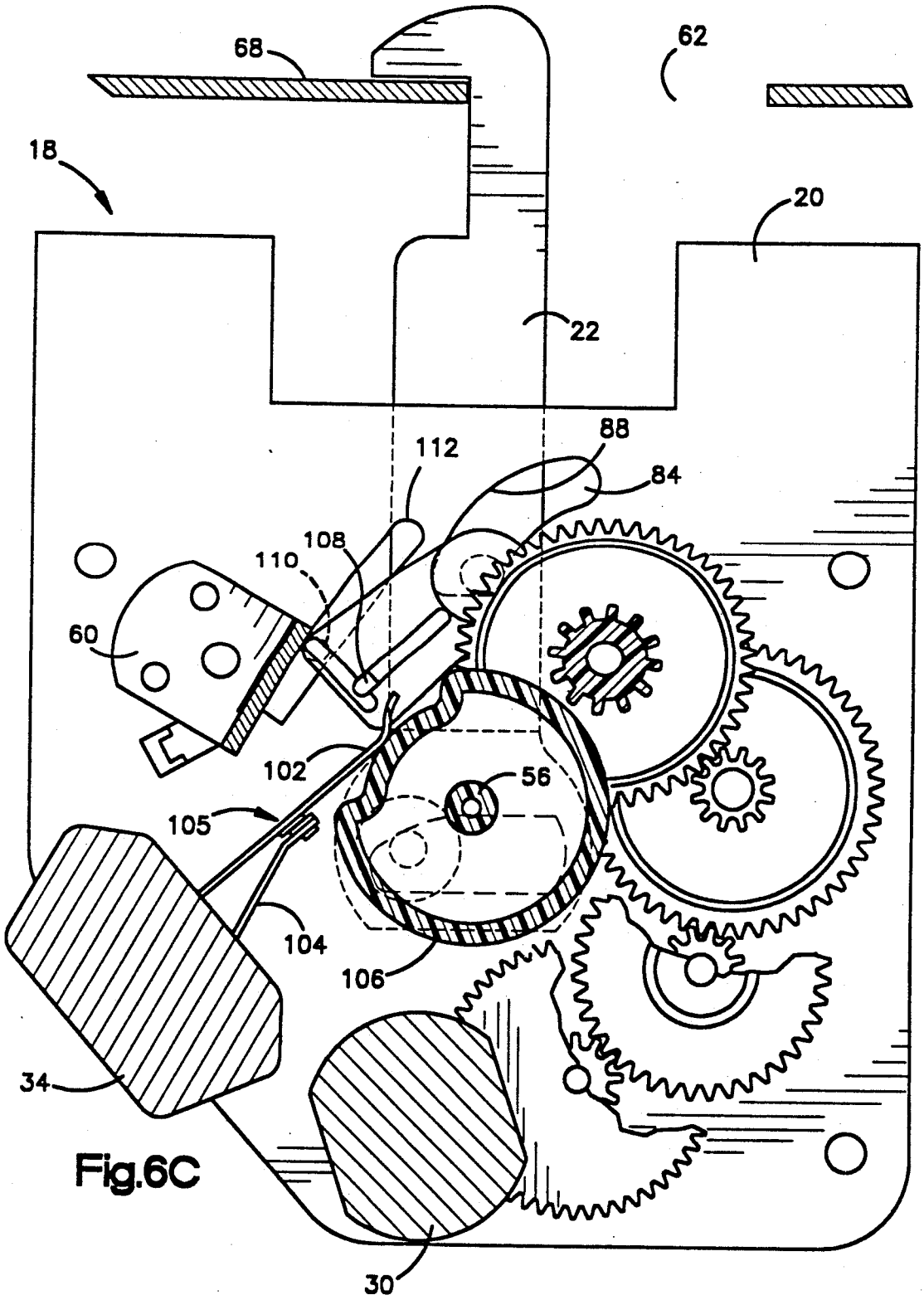

When the door 16 is in a closed position, the latch arm 22 extends through a slot 62 in the door 16. When the door 16 is closed and the motor 30 is energized, the latch arm 22 is adapted to swing laterally from an unlatched position (FIG. 6A) to an intermediate position (the arm's vertical position as viewed in the drawings) and translationally to a latched position (FIG. 6B). When the latch arm 22 moves to its latched position, a hook 64 will engage a strike 68 on the door 16 and will pull the door 16 securely against the frame 12 and the motor 30 will stop. If, however, the door 16 is open when the motor 30 is energized, the latch arm 22 will move from its unlatched position to a third position (FIG. 6D) before reversing and returning to its unlatched position (FIG. 6A) and then stopping in one continuous cycle. Thus, the latch mechanism senses the presence of the door 16 and its path is altered accordingly.

Referring to FIG. 5, the latch arm 22 includes an irregular-shaped cut-out 70 at its proximal end, a pair of slider legs 72, and a follower pin 74. These parts serve to guide and direct the motion of the latch arm 22. The slider legs 72 provide bearing surfaces for the latch arm 22 to ride on the surface of the mounting plate 20.

The cut-out 70 serves to receive and engage the driver pin 24. The driver pin 24 has a large flattened head 76 which serves to retain the latch arm 22. Two walls 78 extending from the mounting plate 20 lie on opposite sides of the latch arm 22 for restricting side to side motion of the proximal end of the latch arm 22. When the motor 30 is energized, the driver pin 24 orbits the drive shaft 56 and engages the cutout and, in so doing, causes the latch arm 22 to move translationally.

Figure 7B:
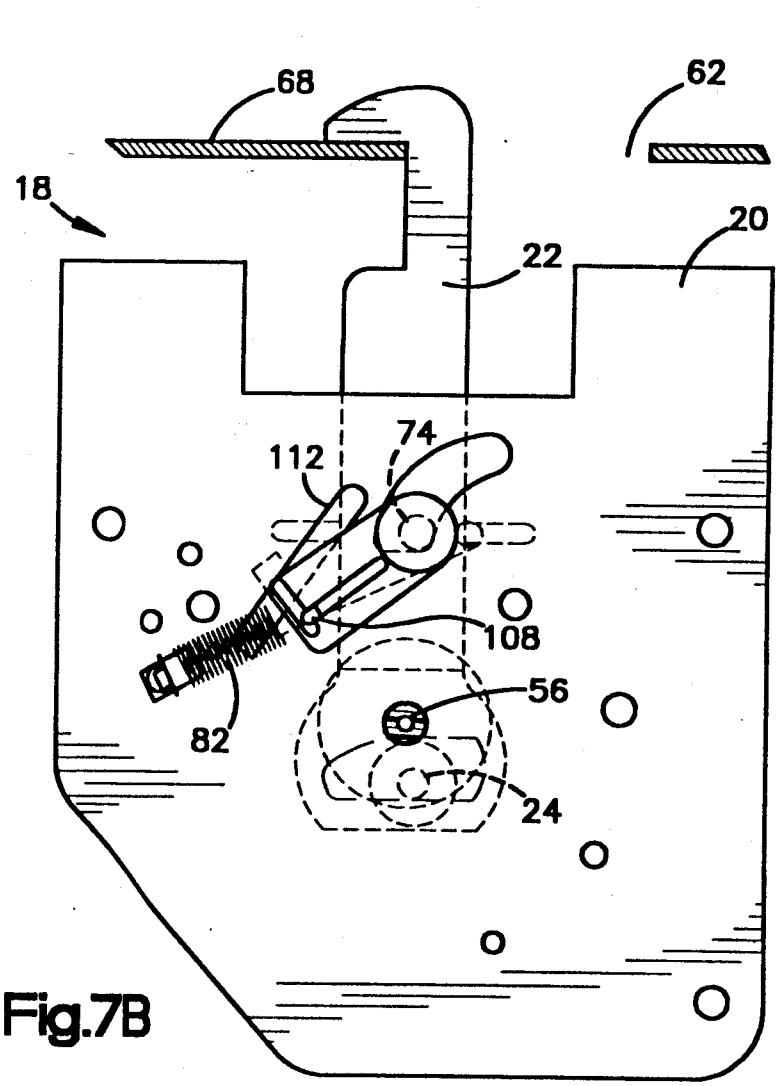
FIGS. 7A–7F are partial plan views showing selected parts in positions corresponding to FIGS. 6A–6F.
Figure 7A:
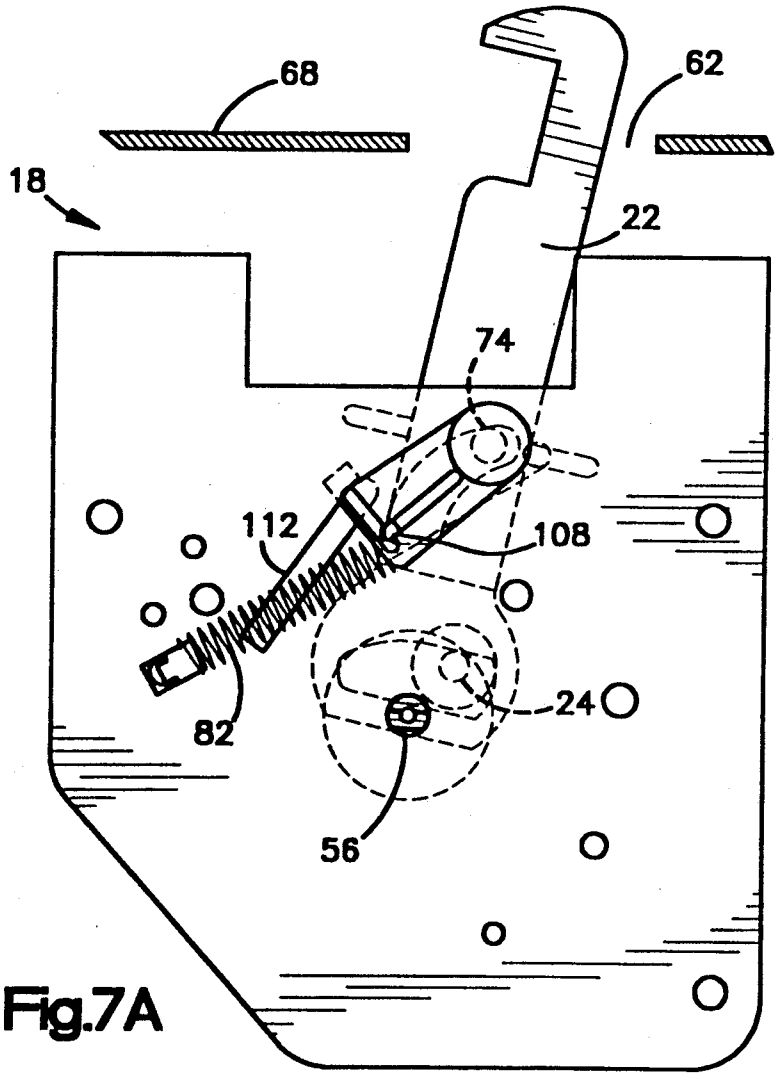

Referring to FIG. 5, the motion of the latch arm 22 is also governed by a spring 82 and a cut-out 84 formed in the mounting plate 20. The follower pin 74 extends from the latch arm 22 in a direction perpendicular to the latch arm 22 into the cut-out 84. The cut-out 84 generally determines the lateral motion of the latch arm 22 as the pin 74 engages and follows a sloped cam surface 88 of the cut-out 84. The spring 82 is connected between the latch arm 22 and the mounting plate 20 to urge the pin 74 toward the cam surface 88. Thus, as the driver pin 24, orbiting clockwise as viewed in FIG. 7A, drives the latch arm 22 in a direction toward its terminal or hook end, the follower pin 74 forces the latch arm 22 to swing laterally towards the unlatched position as it follows the cam surface 88. As the driver pin 24 moves the latch arm 22 inwardly, the latch arm 22 moves laterally away from its unlatched position as the pin 74 follows the cam surface 88.

If the door 16 is closed when the motor 30 is energized, the follower pin 74 will follow the cam surface 88 until the latch arm 22 engages the strike 68. The driver pin 24 will, however, continue to move the latch arm 22 in an inward direction to pull the door 16 securely against the frame 12.

Figure 6D:
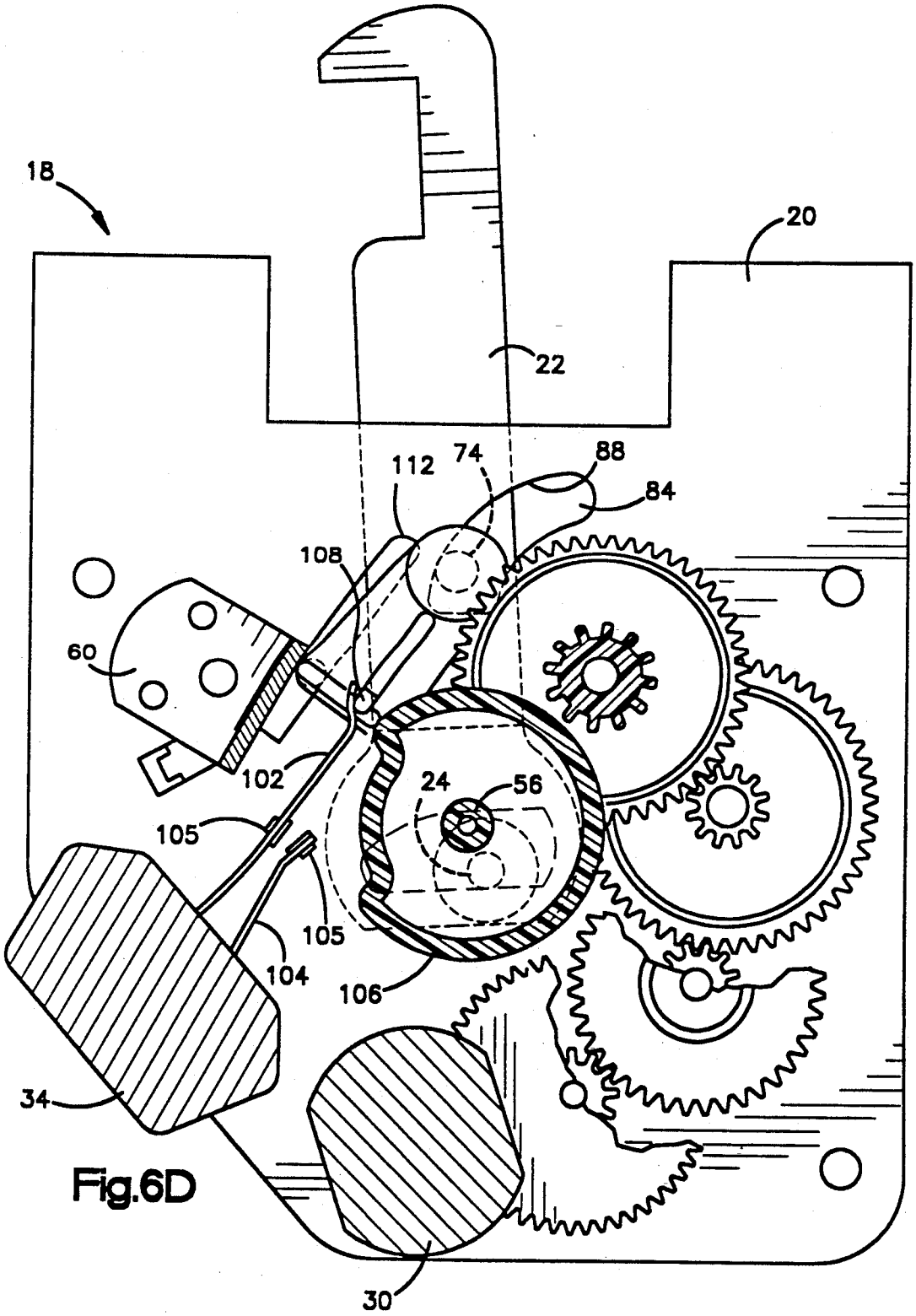
Figure 6E:
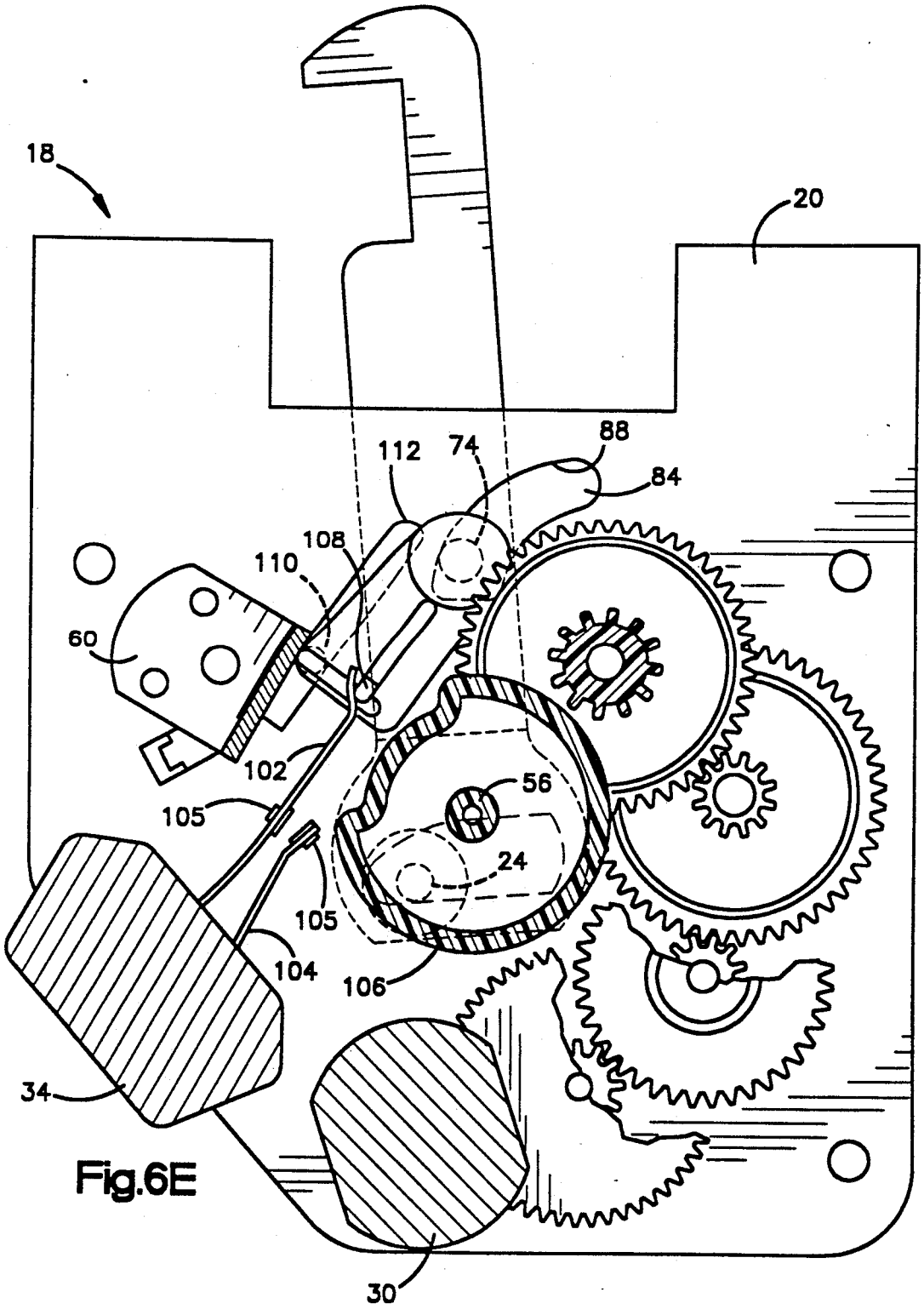
Figure 6F:
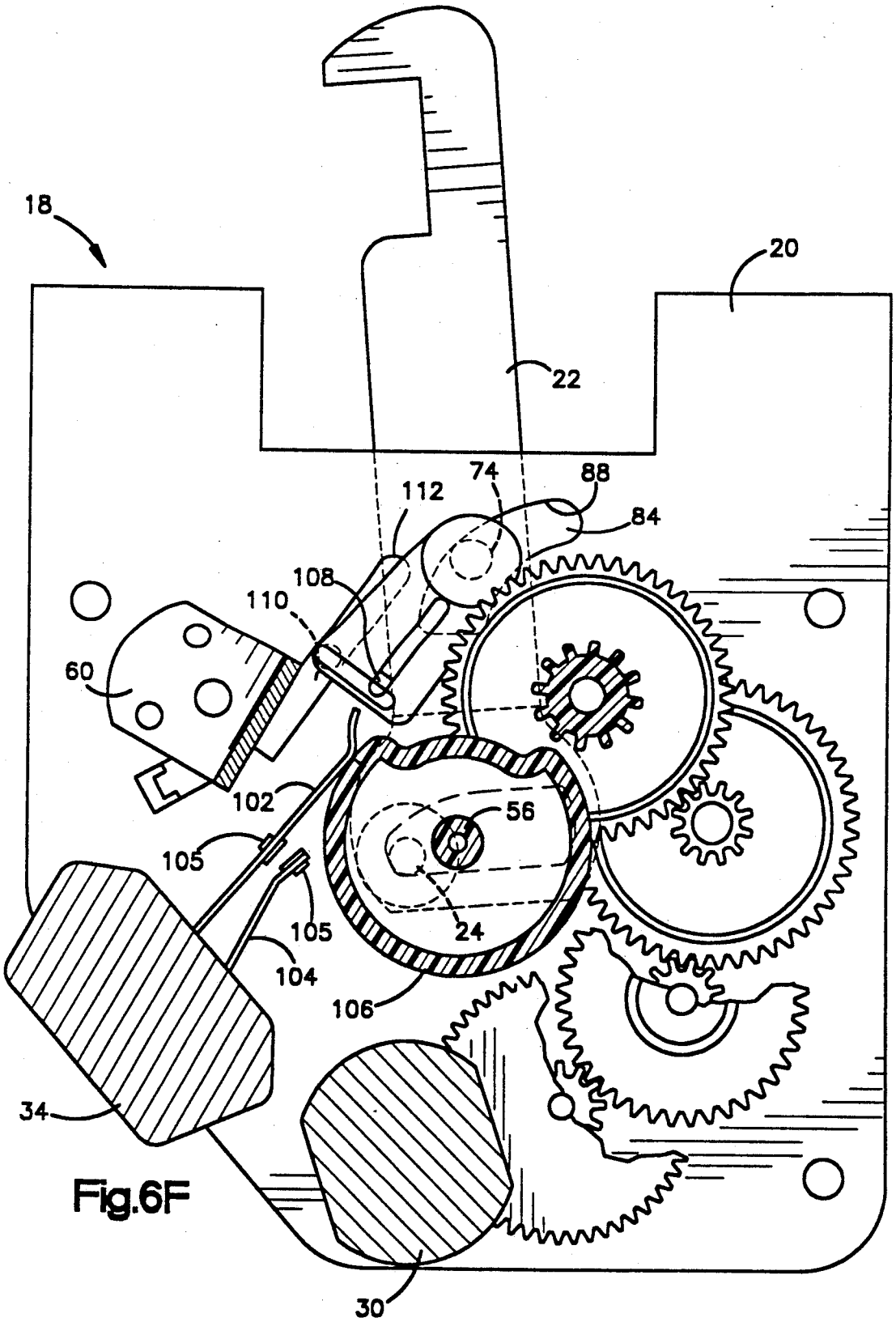
Figure 7D:
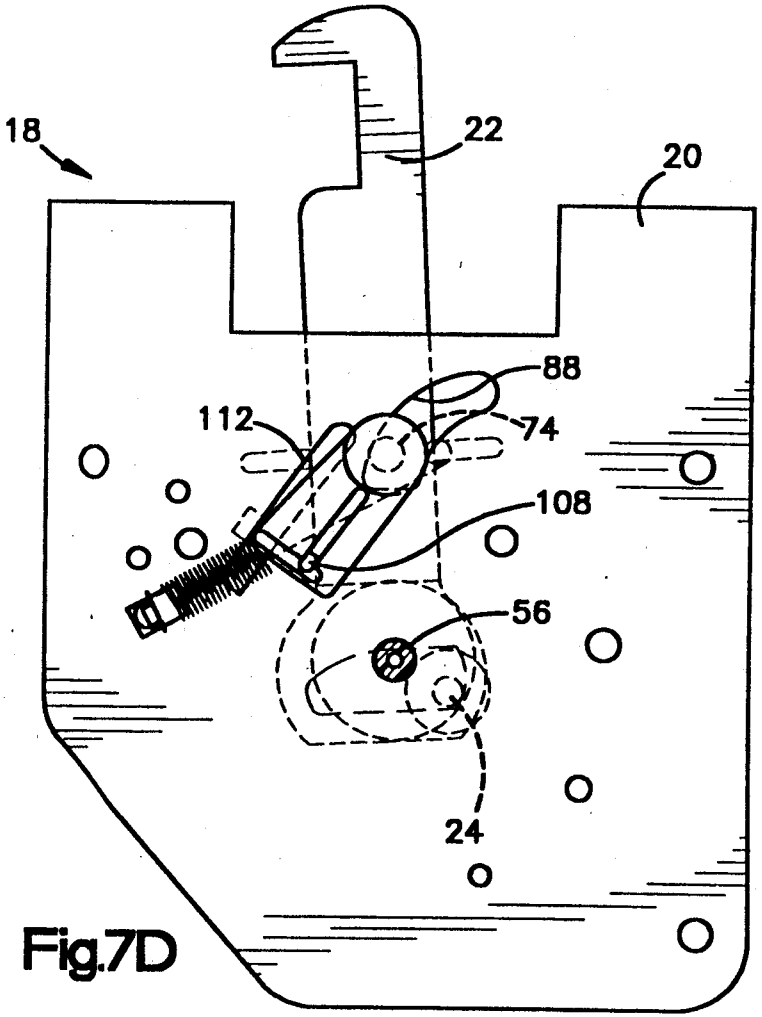
Figure 7C:
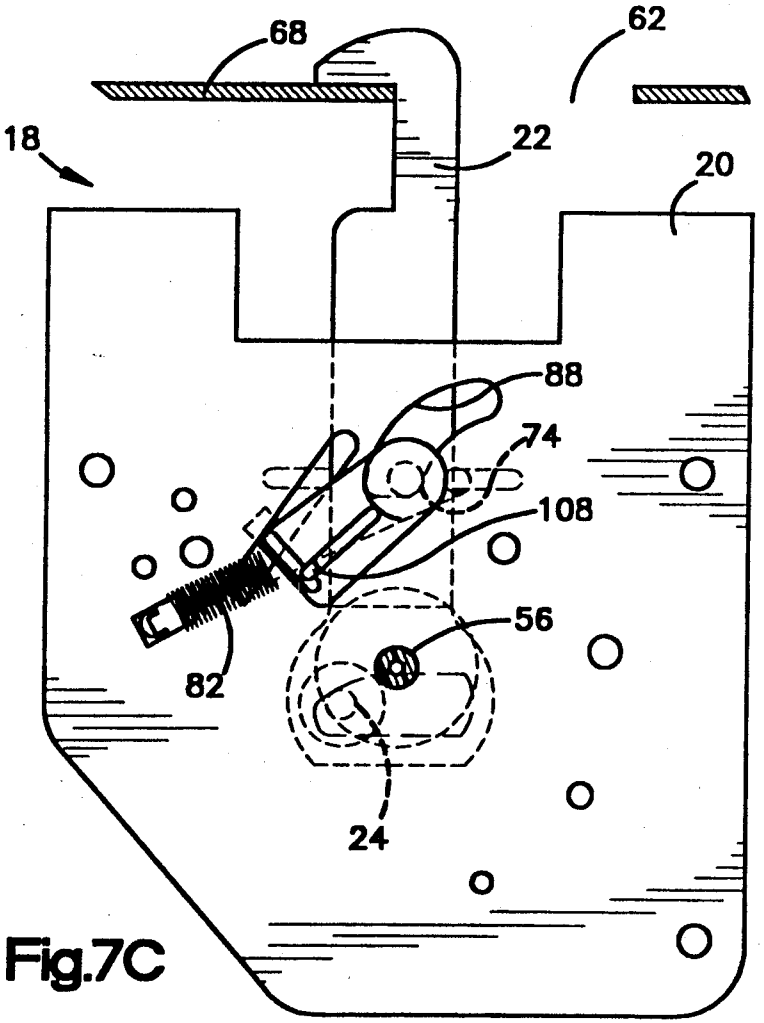
Figure 7F:
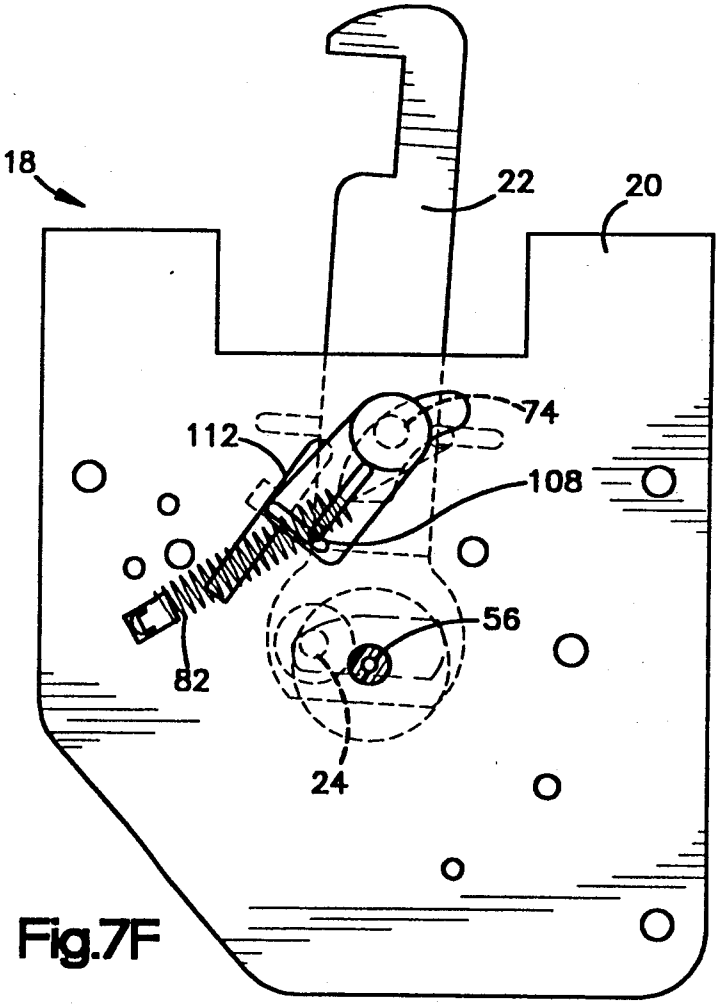
Figure 7E:
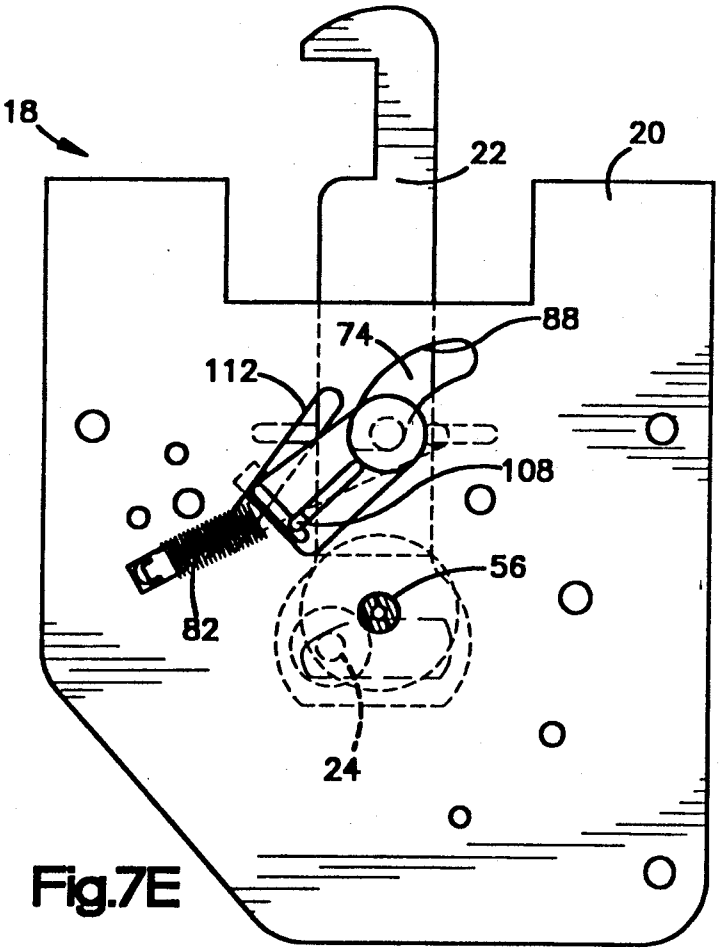

If the door 16 is open when the motor 30 is energized, the latch arm's 22 lateral motion is governed by the shape of the cam surface 88. With the door 16 open, the latch arm 22 moves arcuately through the intermediate position and all the way to the third position (FIGS. 7D and 6D). The motor 30 continues to run causing the latch arm 22 to reverse in the third position and move back to its unlatched position in one continuous 360° cycle of the drive pin 24.

The D.C. motor 30 is controlled and powered by the D.C. powered electronic control unit 32, which is preferably a microprocessor. The control unit 32 provides D.C. current to the D.C. motor 30 at times determined by the positions of a pair of switches 90, 92 formed in the switch block 34. Each switch 90, 92 is actuated by a separate surface of the program cam 26. Since the movement of the latch arm 22 corresponds to the movement of the program cam 26, the switches 90, 92 which are controlled by the program cam 26 serve to signal the position of the latch arm 22 to the controller. A first switch 90 has a follower arm 94 and a stationary arm 96 which have a pair of electrical contacts 98 forming the switch 90. The follower arm 94 is spring biased against a first cam surface 100. The follower arm 94 keeps the switch 90 open when following the high portion of the first cam surface 100. When a low portion of the first cam surface 100 reaches the follower arm 94, the switch 90 is closed signalling the controller 32 to stop the motor 30. The cam 26 is constructed to close the first switch 90 when the latch arm 22 is in its unlatched position which signals the controller 32 to stop the motor 30.

Similarly, a second switch 92 has a follower arm 102, and a stationary arm 104, and a pair of electrical contacts 105. The second switch 92 is maintained open by a high portion of a second cam surface 106. The second switch 92 is closed by a low portion of the second cam surface 106 when the latch arm 22 is in its latched position. The closing of the second switch 92 signals the controller 32 to stop the motor 30. The signal from the second switch 92 also verifies to the controller 32 that the door 16 is latched so that heat-cleaning may be started.

A override member 108 serves to prevent the second switch 92 from sending a signal to the controller 32 if the door 16 is open when the self-clean operation is initiated. Thus, absent a signal from the second switch 92, the controller 32 will not stop the motor 30 and will not start a heat-cleaning operation. The override member 108 is connected to the latch arm 22 to engage the follower arm 102 of the second switch 92 only when the latch arm 22 approaches its third position, which only occurs if the door 16 is open. While the override member 108 is engaging the follower arm 102, it cannot follow the low portion of the cam surface 106 and cannot close the contacts 105. Thus, the motor 30 will continue to run as the latch arm 22 moves to its third position, reverses, and returns to its unlatched position whereupon the first switch 90 causes the motor 30 to be stopped. When the latch arm 22 moves toward its unlatched position, the override member 108 will disengage from the follower arm 102. However, by this time, the high portion of the cam surface 106 will have reached the follower arm 102. Thus, the switch 92 will not be closed when the override member 108 disengages.

The override member 108 is pivotally connected at one end to the follower pin 74. The opposite end of the finger 108 has a projection 110 which fits within a slot 112 formed in the mounting plate 20. The projection 110 follows the slot 112 and thus guides the finger 108 into engagement with the distal end of the follower arm 102.

Figure 8:
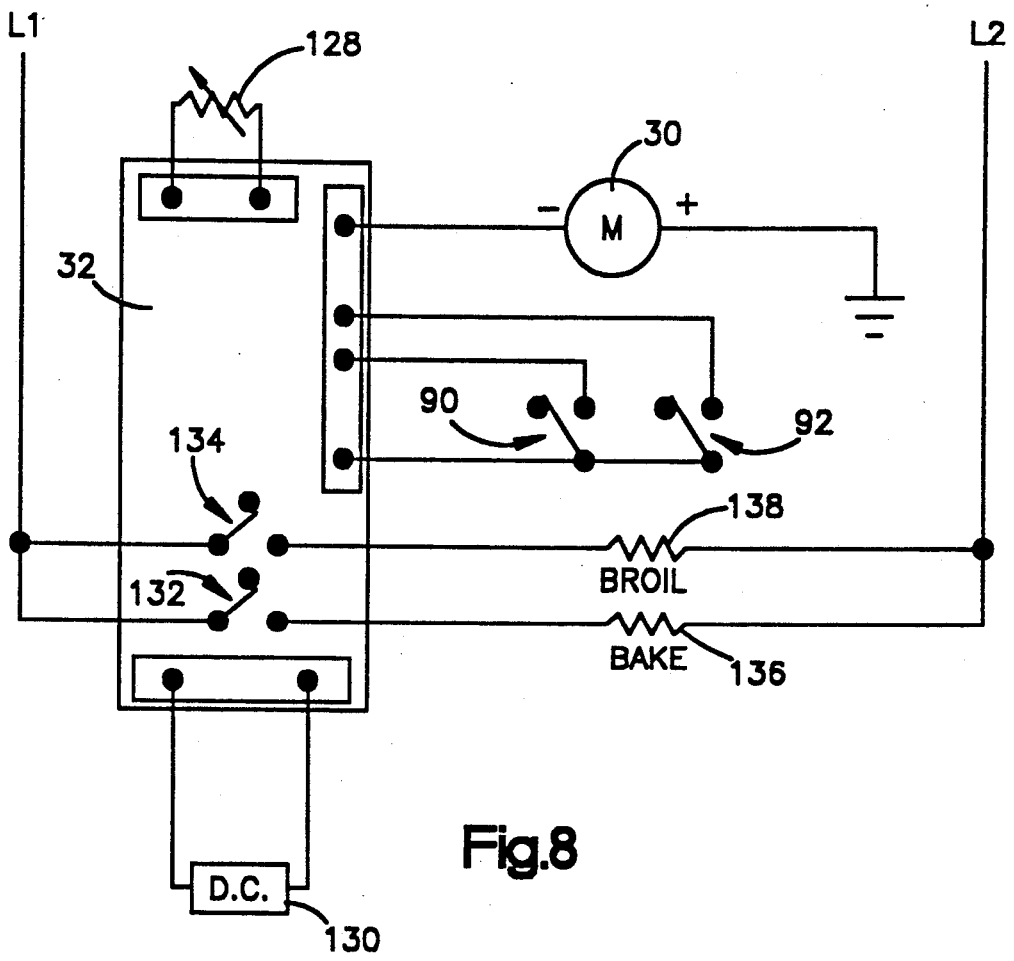
FIG. 8 is a schematic diagram representing portions of the control circuit of the latch mechanism.

Referring to FIG. 8, a partial schematic diagram of the control circuit is shown. A temperature sensor 128 provides an electronic measure of the temperature of the cooking chamber 14. A D.C. power supply 130 powers the control unit 32. A pair of D.C. relays 132, 134 controls A.C. power to heating elements 136, 138. The controller is preferably a low-voltage D.C. microprocessor controller such as a commercially available ERC manufactured and sold by Robertshaw Controls Company of Richmond, Va.

Figure 9:
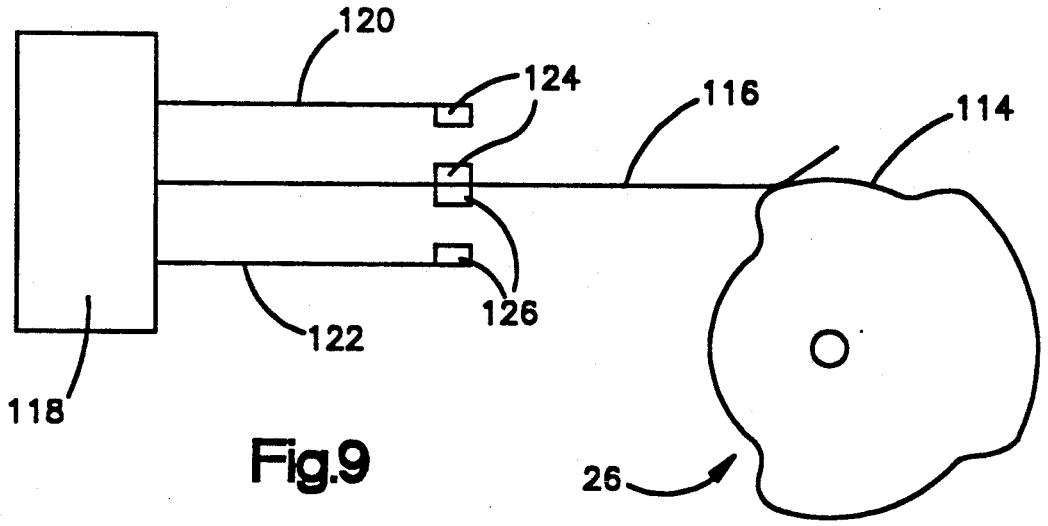
FIG. 9 is a diagrammatic representation of an alternate program cam and switch block for the latch mechanism.

Referring to FIG. 9, in a second embodiment of the latch mechanism, a single, three position cam surface 114 is employed to control a single follower arm 116 of a three position switch 118. The switch 118 includes two stationary arms 120, 122. In all other respects, this embodiment functions like that described above. When the follower arm 116 engages a high portion of the cam surface 114, a pair of contacts 124 are closed signalling to the controller 32 that the latch arm 22 is in its unlatched position. Thus, the contacts 124 perform the same function as the contacts 98 of the first embodiment. When the follower arm 116 engages a low portion of the cam surface 114, a pair of contacts 126 are closed signalling to the controller 32 that the latch arm 22 is in its latched position. Thus, the contacts 126 perform the same function as the contacts 105 of the first embodiment. Just as in the first embodiment, the override member 108 engages and restrains the follower arm 116 when the latch arm 22 approaches its third position when the door 16 is open. Neither pair of contacts are closed when the follower 116 rests on an intermediate surface of the cam surface 114 as illustrated in FIG. 8.

The latch mechanism 18 is constructed of heat-resistant materials such that it can withstand temperatures of approximately 180° C. For example, the gears 36, 40, 44, 48 and their integral pinions 38, 42, 46, 50 are made of thermoset phenolic material. In addition, the motor 30 is able to withstand temperatures of approximately 180° C. with no additional cooling. A.D.C. motor able to withstand such temperatures is commercially available under the trademark BUEHLER. This allows the entire latch mechanism 18 to be mounted above the cooking chamber 14 at the front and center of the oven which is a relatively hot location.

While preferred embodiments of this invention have been described in detail, it will be apparent that certain modifications or alterations can be made without departing from the spirit and scope of the invention set forth in the appended claims.

We claim:

1. For use in a self-cleaning oven having a door movable between open and closed positions, and means for effecting a heat cleaning cycle when said door has been closed and locked, an improved door locking mechanism comprising:

a mounting plate;

a rotatable driver on said plate;

a movable latch arm having a door locking end and an opposite end;

a driver pin carried by said driver in engagement with said opposite end of said arm;

a follower pin carried by said arm between its ends, said plate having a motion control slot through which said pin extends;

a motor on said plate;

a gear drive mounted on said plate between said motor and said driver;

said locking end of said arm being movable arcuately between an unlocked position and a reversing position and translationally between an intermediate position and a locking position, whereby actuation of said motor and unidirectional rotation of said driver when the door is closed will cause said locking end of said arm to move from said unlocked position to said intermediate position and to said locking position, and whereby actuation of said motor and unidirectional rotation of said driver when the oven door is open will cause said locking end of said arm to move from said unlocked position through said intermediate position to said reversing position and back to said unlocked position;

switch means on said plate for sensing the locked and unlocked positions of said arm;

said gear drive including rotatable program means for permitting actuation of said switch means in said locked and unlocked positions of said arm;

an override member carried by said arm; and means mounting said override member for movement on said plate to engage and prevent actuation of said switch means when said locking end of said arm is moved through said intermediate position with the oven door open.

2. For use in a self-cleaning oven having a door movable between open and closed positions, and means for effecting a heat cleaning cycle when said door has been closed and locked, an improved door locking mechanism comprising:

a mounting plate;

a movable latch arm;

a latch arm drive on said plate including a motor, a drive member rotatable through 360° in operative engagement with said latch arm, and a gear drive operatively interposed between said motor and said drive member;

said arm and plate including structure for controlling the path of movement of said latch arm whereby actuation of said motor and unidirectional rotation of said driver when the door is closed will cause said locking end of said arm to move from said unlocked position to said intermediate position to said locking position, and whereby actuation of said motor and unidirectional rotation of said driver when the oven door is open will cause said locking end of said arm to move from said unlocked position through said intermediate position to said reversing position and back to said unlocked position;

switch means for sensing the locked and unlocked positions of said arm;

rotatable program means for permitting actuation of said switch means in said locked and unlocked positions; and means carried by said arm for overriding said program means and preventing actuation of said switch means when said arm moves to said reversing position.

3. A latch mechanism for latching an oven door to the frame of a heat-cleaning oven, said mechanism having a latch arm being adapted to move between a non-latching position wherein the door may be opened and closed and a latching position which locks the door in a closed position, said latch arm being further adapted to move to a third position if the door is open when said latch arm is actuated;

a unidirectional rotatable drive means for driving said latch arm to its latched position if the door is closed and to its third position if the door is open; and a control means for starting said drive means when a heat-cleaning operation is signalled, stopping said drive means when said latch arm reaches its latched position, and, if said door is open, for operating said drive means continuously while said latch arm moves to its third position and until said latch arm reaches its unlatched position.

4. A latch mechanism according to claim 3 wherein said control means comprises a cam rotatably connected to said drive means and a follower having a switch operatively connected thereto and wherein said switch signals an electronic control unit that said latch is in its latched position.

5. A latching mechanism according to claim 3 and further comprising a mounting plate adapted to be mounted above a cooking chamber and proximate to said door, wherein said drive means includes a motor mounted to said mounting plate.

6. For use in a self-cleaning oven having a door movable between open and closed positions, and means for effecting a heat cleaning cycle when said door has been closed and locked, an improved door locking mechanism comprising:

a mounting plate;

a movable latch arm;

a latch arm drive on said plate including a D.C. motor, and a drive member rotatable through 360° in operative engagement with said latch arm;

said arm and plate including structure for controlling the path of movement of said latch arm whereby actuation of said motor and unidirectional rotation of said drive member when the door is closed will cause said latching end of said arm to move from said unlatched position to said locking position, and whereby actuation of said motor and unidirectional rotation of said driver when the oven door is open will cause said latching end of said arm to move from said unlatched position to a third position;

a D.C. powered controller; and a D.C. power source for powering said controller;

wherein said motor is connected directly to said controller with a D.C. circuit such that said controller switches the current powering said motor.

7. A door locking mechanism as claimed in claim 6 wherein said drive member causes the latch member to reverse in its third position and return to its unlatched position in one continuous cycle of the drive member.

8. A door locking mechanism as claimed in claim 6 wherein a cam is rotatably connected to said drive member and wherein a follower engageable with said cam operates a switch for signalling said controller when said latch arm is in its latched position.

* * * * *